US008172706B2

(12) United States Patent
Peery et al.

(10) Patent No.: US 8,172,706 B2
(45) Date of Patent: May 8, 2012

(54) BASKETBALL SYSTEM

(75) Inventors: Wendell Peery, Kaysville, UT (US); Brent Steed, Syracuse, UT (US); Gary Phillips, Clearfield, UT (US); Robert A. Astle, Farmington, UT (US)

(73) Assignee: Lifetime Products, Inc., Clearfield, UT (US)

( * ) Notice: Subject to any disclaimer, the term of this patent is extended or adjusted under 35 U.S.C. 154(b) by 236 days.

(21) Appl. No.: 12/037,530

(22) Filed: Feb. 26, 2008

(65) Prior Publication Data

US 2008/0214333 A1 Sep. 4, 2008

Related U.S. Application Data

(60) Provisional application No. 60/892,796, filed on Mar. 2, 2007.

(51) Int. Cl.
*A63B 63/08* (2006.01)

(52) U.S. Cl. ..... 473/483

(58) Field of Classification Search ..... 473/481, 473/483

See application file for complete search history.

(56) References Cited

U.S. PATENT DOCUMENTS

| | | | | |
|---|---|---|---|---|
| 4,185,936 A | | 1/1980 | Takahashi | |
| 4,798,381 A | * | 1/1989 | Dadbeh | 473/484 |
| 4,801,142 A | | 1/1989 | Friesen | |
| 4,805,904 A | | 2/1989 | Nye | |
| 5,388,821 A | | 2/1995 | Blackburn | |
| 5,465,957 A | * | 11/1995 | Schroeder | 473/484 |
| 6,120,396 A | | 9/2000 | VanNimwegen et al. | |
| 6,155,938 A | * | 12/2000 | Mower | 473/484 |
| 6,273,834 B1 | | 8/2001 | Winter | |
| 6,283,878 B1 | * | 9/2001 | White | 473/484 |
| 6,422,957 B1 | | 7/2002 | Winter et al. | |
| 2005/0277492 A1 | | 12/2005 | Nye et al. | |

FOREIGN PATENT DOCUMENTS

| | | |
|---|---|---|
| CN | 2640548 | 9/2004 |

OTHER PUBLICATIONS

International Search Report and Written Opinion from PCT/US2008/055110, dated Aug. 1, 2008, 10 pages.

International Preliminary Report on Patentability, dated Sep. 17, 2009, 7 pages.

* cited by examiner

*Primary Examiner* — Gene Kim
*Assistant Examiner* — Amir Klayman
(74) *Attorney, Agent, or Firm* — Workman Nydegger

(57) ABSTRACT

A basketball system may include a basketball goal and a support structure that is sized and configured to support the basketball goal above a playing surface. The basketball system may also include an adjustment assembly that is sized and configured to allow the height of the basketball goal to be adjusted. The adjustment assembly may include an arm that is connected to the structure connecting the basketball goal and the support structure. The arm may include a plurality of receiving portions, such as openings or slots, and an engaging member may be connected to the support structure. When the engaging portion is connected to a first receiving portion, the basketball goal may be disposed at a first height. Preferably, when the engaging portion is connected to a second receiving portion, the basketball goal may be disposed at a second height. The adjustment assembly may also include a locking mechanism that is sized and configured to lock the arm and basketball goal in a desired position.

19 Claims, 10 Drawing Sheets

BASKETBALL SYSTEM

CROSS-REFERENCE TO RELATED APPLICATIONS

This application claims priority to and the benefit of U.S. provisional patent application Ser. No. 60/892,796, filed Mar. 2, 2007 and entitled BASKETBALL SYSTEM, which is incorporated by reference in its entirety.

BACKGROUND OF THE INVENTION

1. Field of the Invention

The present invention generally relates to basketball systems and, in particular, to a height adjustment mechanism for a basketball system.

2. Description of Related Art

The game of basketball is played by many people throughout the United States and the world. Briefly, the game of basketball typically includes a flat and level playing surface with a basketball goal at each end of the court. The basketball goal, which may include a backboard and a rim or hoop, is typically attached to the top of a support pole. The rim or hoop is normally located ten feet above the playing surface and the backboard may be constructed from materials such as wood, plastic or tempered glass.

Conventional basketball goals typically include a backboard that is positioned perpendicular to the playing surface and a rim that is positioned parallel to the playing surface. The rim is often rigidly mounted to the basketball backboard or goal, but the rim may also be pivotally mounted to the basketball backboard or goal to create a movable or break-away type rim.

Conventional basketball systems may also be permanently secured in a fixed location. For example, the end of the support pole may be inserted into the ground so that the basketball system is disposed in a fixed location. In addition, conventional basketball systems may be attached to structures such as a wall, roof or the like. Known basketball systems may also be part of a portable basketball system that are sized and configured to be selectively moved from one location to another. For example, known portable basketball systems may include a base with a hollow interior that is sized and configured to be filled with ballast such sand or water. These known portable basketball systems may include wheels and a handle to facilitate movement of the basketball system.

Basketball systems that allow the height of the basketball goal relative to the playing surface to be adjustable are also known. These known adjustable height basketball system may allow basketball to be played by a wide variety of persons. For instance, the adjustable height basketball system may be used by relatively tall players for some games and by shorter players during other games. The adjustable height basketball system may also be used by players of different strengths or skill levels. In addition, the adjustable height basketball system may be used by adults or children. Further, the adjustable height basketball system may also be used to play a regulation game of basketball or for practicing skills such as dunking the basketball.

Many conventional adjustable height basketball systems, however, are difficult to use and time consuming to adjust. Additionally, many conventional adjustable height basketball systems have complicated designs with numerous parts and connections, which may undesirably increase the cost of the system. These known basketball systems with numerous parts and connections may also be difficult to assemble and repair. In addition, many known adjustable height basketball systems have relatively large components, which may require a large amount of space. Further, some known adjustable height basketball systems are difficult to adjust so that the basketball goal is at the desired height.

BRIEF SUMMARY OF EMBODIMENTS OF THE INVENTION

A need therefore exists for a basketball system that eliminates or diminishes the above-described and/or other disadvantages and problems.

One aspect is a basketball system that may include a basketball goal, which may include a backboard, a rim and a net. The basketball system may also include a support structure that is sized and configured to support the basketball goal at a desired height above a playing surface. The support structure is preferably sized and configured to selectively support the basketball goal at a variety of heights, which may allow adults, children and others to play basketball. Thus, the height of the basketball goal is preferably adjustable relative to the playing surface.

Advantageously, the basketball system may form part of a permanent or portable basketball system. In addition, the basketball system may be used with different types of basketball goals and/or components such as different types, sizes and configurations of backboards, rims, support structures, support poles and the like.

Another aspect is a basketball system that may include a support structure which may include one or more support members. One or more of the support members may be movable or adjustable, which may allow the height of the basketball goal to be adjusted.

Still another aspect is a basketball system that may include a height adjustment mechanism to allow the height of the basketball goal to be adjusted. In particular, the basketball system may include an adjustment assembly which is sized and configured to adjust the height of basketball goal. For example, the basketball system may include a support structure with one or more support members and the adjustment assembly may be sized and configured to move at least a portion of at least one of the support members so the height of the basketball goal may be adjusted.

Yet another aspect is a basketball system that may include an adjustment assembly with an arm or elongated member that is sized and configured to move one or more of the support members. For example, the arm may be connected to a support member and moving the arm may cause the support member to move, which may raise or lower the basketball goal. In particular, the arm may be pivotally or movably connected to the support member and moving the arm downwardly may raise the basketball goal and moving the arm upwardly may lower the basketball goal.

A further aspect is a basketball system that may include an adjustment assembly with an arm that is sized and configured to be secured in various positions, which may allow the height of the basketball goal to be adjusted. For example, the arm may include a plurality of receiving portions, such as slots or openings, and one or more engaging portions may be sized and configured to be disposed within the receiving portions. In particular, the adjustment assembly may include one or more engaging members that are sized and configured to engage the receiving portions. When one or more of the receiving and engaging portions are engaged, the arm may be secured in a fixed position. Advantageously, when the arm is secured in a fixed position, the basketball goal may also be secured in a fixed position.

A still further aspect is a basketball system that may include an adjustment assembly with an arm and one or more engaging members. For example, the basketball system may include an engaging member that is sized and configured to contact, abut and/or engage one or more receiving portions disposed in the arm. The basketball system may also include additional engaging members that are sized and configured to contact, abut and/or engage other portions of the arm, which may help restrict the movement of the arm relative to the first engaging member and that may help maintain the arm in a desired position. For instance, a first engaging member may include a fastener (such as a bolt and nut or the like) and a portion of the fastener may be inserted into an opening in the arm, while additional engaging members (such as a bracket, a cam, a tab and/or other structures) may help maintain the arm in a position in which the first engaging member engages or is disposed in the opening. Thus, the engaging members may help secure the arm in a fixed position and the basketball goal at a fixed height.

Yet another further aspect is a basketball system that may include an adjustment assembly with an arm, a fastener and a stop. The fastener may be sized and configured to contact, abut and/or engage one or more coupling or receiving portions of the arm. The fastener may also help attach a bracket to the support structure, and the stop may be connected to the bracket. The stop is preferably movably connected to the bracket and the stop is preferably sized and configured to move between a locked position and an unlocked position. When the stop is in the locked position, the stop may help to maintain the arm in a first position in which the fastener engages a first receiving portion of the arm. When the stop is moved to the unlocked position, the arm may be moved because the fastener does not engage any of the receiving portions. The arm may then be moved to a second position in which the fastener engages a second receiving portion of the arm, and the stop may be returned to the locked position to help maintain the arm in the second position. If desired, the bracket may be positioned to help restrict lateral movement of the arm. For example, the bracket may be sized and configured to contact, abut and/or engage opposing sides of the arm to help restrict the lateral movement of the arm.

Another aspect is a basketball system that may include an adjustment assembly with a biasing member. For example, the adjustment assembly may include a biased stop, such as a biased tab or cam. In particular, the biased stop may include a gravity-biased cam with an enlarged portion that is sized and configured to allow gravity to bias the cam towards the locked position. The range of movement of the cam may be limited, if desired. For instance, a pin may be connected to the cam and the pin may contact, abut and/or engage the bracket to help prevent the cam from moving outside of a desired range of motion, such as past the locked position. It will be appreciated that any suitable type of biasing member and structures may be used in connection with the adjustment assembly. For example, a spring or other resilient structures may be used to exert a force against the cam in order to bias the cam into a desired position.

Still another aspect is a basketball system that may include an adjustment assembly with an arm and a fastener, such as a bolt and nut. The bolt may be sized and configured to contact, abut and/or engage any of a plurality of receiving portions of the arm to help secure the arm in a generally fixed position. The nut may be sized and configured to contact abut and/or engage a portion of the arm (such as an outer surface of the arm) to help limit how far the bolt may be inserted into a receiving portion. For example, the nut may have an elongated shape and that may help prevent the end of the bolt from contacting and/or damaging an interior portion of the arm.

Yet another aspect is a basketball system that may include an adjustment assembly, which may include an arm and a plurality of fasteners. For example, a first fastener may be sized and configured to contact, abut and/or engage any of a plurality of receiving portions formed in the arm to help secure the arm in a generally fixed position. A second fastener may be sized and configured to contact, abut and/or engage a portion of the arm to help limit the engagement or how far the first fastener may be inserted into a receiving portion.

A further aspect is a basketball system that may include a dampener such as a spring or other biasing member. The dampener is preferably sized and configured to assist in adjusting the height of the basketball goal. For example, the dampener may facilitate movement of the basketball goal from a first position to a second position. In particular, the dampener may be used to at least partially counteract the force of gravity to allow the basketball system to be more easily adjusted.

A still further aspect is a basketball system may include a basketball goal with a backboard and a rim. The basketball system may also include a support structure that is sized and configured to support the basketball goal above a playing surface. The support structure may include an elongated support member that is generally vertically disposed relative to the playing surface and a support assembly which connects the elongated support member to the basketball goal. The support assembly may include one or more connecting members that connect the elongated support member and the basketball goal. The basketball system may also include a height adjustment assembly to allow the height of the basketball goal to be adjusted.

Yet another further aspect is a basketball system that includes a basketball goal, a support member and a support assembly that connects the basketball goal and the support member. Preferably a portion of the basketball goal, a first connecting member of the support assembly, a portion of the elongated support member and a second connecting member of the support assembly form at least a portion of a four-bar linkage. These components may also be pivotally connected to form part of a four-pivot linkage, if desired. In addition, a portion of the basketball goal, the first connecting member of the support assembly, a portion of the elongated support member and the second connecting member of the support assembly may have a generally parallelogram configuration.

Another aspect is a basketball system that may comprise a basketball goal including a backboard and a rim, and a support structure that is sized and configured to support the basketball goal at a plurality of heights. The support structure may comprise a support pole and one or more connecting members connecting the support pole and the basketball goal. The basketball system may also include an adjustment assembly that is sized and configured to adjust the height of the basketball goal. The adjustment assembly may comprise an arm connected to at least one of the connecting members, the arm may include a first receiving portion and a second receiving portion; and an engaging member that extending outwardly from the support pole, the engaging member may be sized and configured to engage the first receiving portion of the arm to secure the basketball goal at a first height and to engage the second receiving portion of the arm to secure the basketball goal at a second height. The adjustment assembly may further comprise a bracket connected to the support pole and a stop movably connected to the bracket, the stop being sized and configured to move between a locked position and an unlocked position; wherein the stop maintains the arm in a fixed position when the stop is in the locked position; and wherein the arm may be generally freely moved in a vertical direction when the stop is in the unlocked position.

Still another aspect is basketball system that may comprise a basketball goal including a backboard and a rim, and a support structure that is sized and configured to support the basketball goal at a plurality of heights. The support structure may comprise a support pole and one or more connecting members connecting the support pole and the basketball goal. The basketball system may also include an adjustment assembly comprising an arm that is sized and configured to adjust the height of the basketball goal, the arm including a first end that is connected to one or more of the connecting members; a first engaging member disposed towards a second end of the arm; a second engaging member disposed towards the second end of the arm; a third engaging member connected to the support pole, the third engaging member being sized and configured to engage the first engaging member to secure the basketball goal at a first height and to engage the second engaging member to secure the basketball goal at a second height; and a stop that is sized and configured to move between a locked position in which the arm is secured in a fixed position relative to the stop and an unlocked position in which the arm is movable relative to the stop. When the stop is in the locked position and the basketball goal is at the first height, the stop preferably maintains the engagement of the first engaging member and the third engaging member. When the stop is locked and the basketball goal is at the second height, the stop maintains the engagement of the second engaging member and the third engaging member. The third engaging member may comprise a fastener including a bolt and a nut, at least a portion of the bolt being sized and configured to engage the first engaging member to secure the basketball goal at a first height and to engage the second engaging member to secure the basketball goal at a second height. If desired, the nut may be sized and configured to contact an outer surface of the arm to restrict the position of the bolt relative to the arm. In addition, the stop may be gravity-biased away from the unlocked position and towards the locked position. Further, the adjustment assembly may comprise a biasing member configured to bias the stop away from the unlocked position and towards the locked position. Additionally, the stop may comprise a cam that maintains the arm in the first position when the stop is in the locked position.

Yet another aspect is a basketball system that may comprise a basketball goal including a backboard and a rim; a support structure that is sized and configured to support the basketball goal above a playing surface; a support assembly connecting the basketball goal and the support structure; and a height adjustment mechanism that allows the height of the basketball goal to be adjusted relative to the playing surface. The height adjustment mechanism may comprise an arm including a first end connected to the support assembly; a first coupling portion disposed towards a second end of the arm; a second coupling portion disposed towards the second end of the arm; a coupling member connected to the support structure, the coupling member being sized and configured to be coupled to the first coupling portion of the arm to secure the basketball goal at a first height relative to the playing surface and to the second coupling portion to secure the basketball goal at a second height relative to the playing surface; and a locking mechanism that is movable between a locked position and an unlocked position, the locked position including the coupling member being coupled to one of the coupling portions of the arm, the locking mechanism being biased to maintain the locking mechanism in the locked position. If desired, the first coupling portion of the arm may comprise a first opening in the arm that is disposed towards the support structure; the second coupling portion of the arm may comprise a second opening in the arm that is disposed towards the support structure; and the coupling member may comprise a projection extending outwardly from the support structure, the projection being sized and configured to be inserted into the first opening to secure the basketball goal at the first height and to be inserted into the second opening to secure the basketball goal at the second height. The locking mechanism may be connected to the support structure by a bracket, and the bracket may include a first flange disposed on a first side of the arm, a second flange disposed on a second side of the arm, and the locking mechanism may be connected to the first flange and the second flange of the bracket. The locking mechanism may be sized and configured to dispose the arm proximate the support structure when the locking mechanism is in the locked position to facilitate coupling of the coupling member and the coupling portions of the arm. In addition, a bracket may be connected to the support structure, the bracket including a first flange and a second flange; and a fastener may connect the locking mechanism to the bracket, the locking mechanism being movable between a locked position in which the coupling member engages a coupling portion of the arm and an unlocked position in which the coupling member and the coupling portion can be readily disengaged. Further, a portion of the arm is disposed between the first flange of the bracket, the second flange of the bracket, the support structure and the locking mechanism.

These and other aspects, features and advantages of the present invention will become more fully apparent from the following detailed description of preferred embodiments and appended claims.

BRIEF DESCRIPTION OF THE DRAWINGS

The appended drawings contain figures of preferred embodiments to further illustrate and clarify the above and other aspects, advantages and features of the present invention. It will be appreciated that these drawings depict only preferred embodiments of the invention and are not intended to limit its scope. The invention will be described and explained with additional specificity and detail through the use of the accompanying drawings in which.

DETAILED DESCRIPTION OF THE PREFERRED EMBODIMENTS

The present invention is generally directed towards a basketball system. The principles of the present invention, however, are not limited to basketball system. It will be understood that, in light of the present disclosure, the system disclosed herein can be successfully used in connection with other types of structures and/or sporting equipment.

Additionally, to assist in the description of the basketball system, words such as top, bottom, front, rear, right and left may be used to describe the accompanying figures, which are not necessarily drawn to scale. It will be appreciated, however, that the basketball system and its components can be located in a variety of desired positions and/or orientations. A detailed description of the basketball system now follows.

Figure 1:
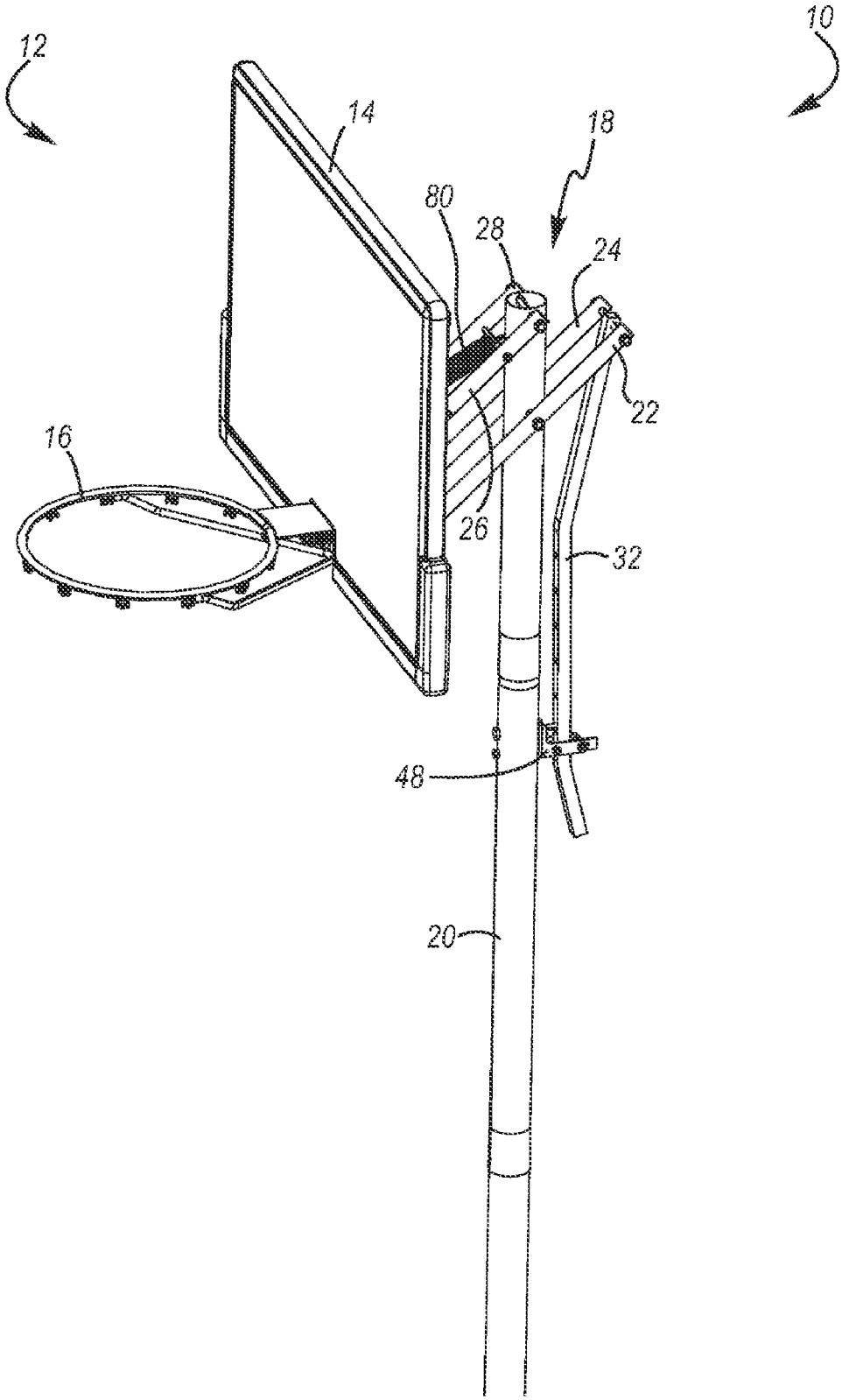
FIG. 1 perspective view of an exemplary basketball system.
Figure 2:
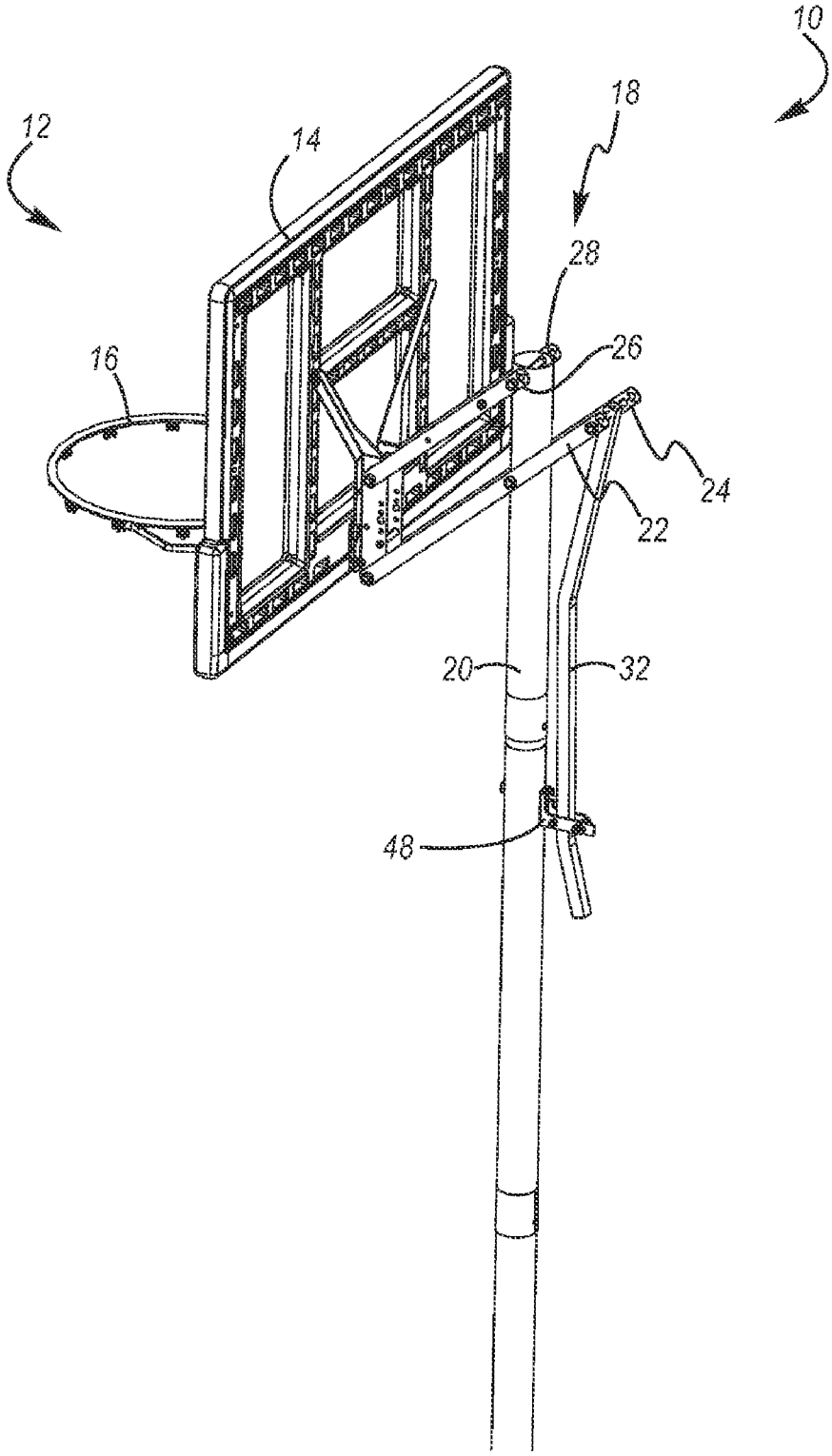
FIG. 2 is a rear perspective view of the basketball system shown in FIG. 1.

As shown in FIG. 1, a basketball system 10 may include a basketball goal 12, which may include a backboard 14, a rim 16 and a net. The basketball system 10 may also include a support structure 18 that is sized and configured to support the basketball goal 12 at a desired height above a playing surface. The support structure 18 is preferably sized and configured to selectively support the basketball goal 12 at a variety of heights, which may allow adults, children and others to play basketball. Significantly, the support structure 18 may form part of a permanent or portable basketball system. The support structure 18 may also be used with different types of basketball systems and/or components such as different types, sizes and configurations of backboards, rims and the like.

The support structure 18 may include one or more support members that are sized and configured to support the basketball goal 12 in the desired location. For example, the support structure could include one or more support members, such as a support pole 20 and connecting members 22, 24, 26 and 28. The support pole 20 is preferably generally vertically oriented relative to the playing surface, but the support pole may be positioned at a variety of other orientations and/or positions relative to the playing surface, if desired.

One or more of the support members may be movable or adjustable, which may allow the height of the basketball goal 12 to be adjusted. For example, the connecting members 22, 24, 26 and 28 may be pivotally or otherwise movably connected to the basketball goal 12 and the support pole 20 and may be moved among a variety of different positions to adjust the basketball goal's height.

Figure 3:
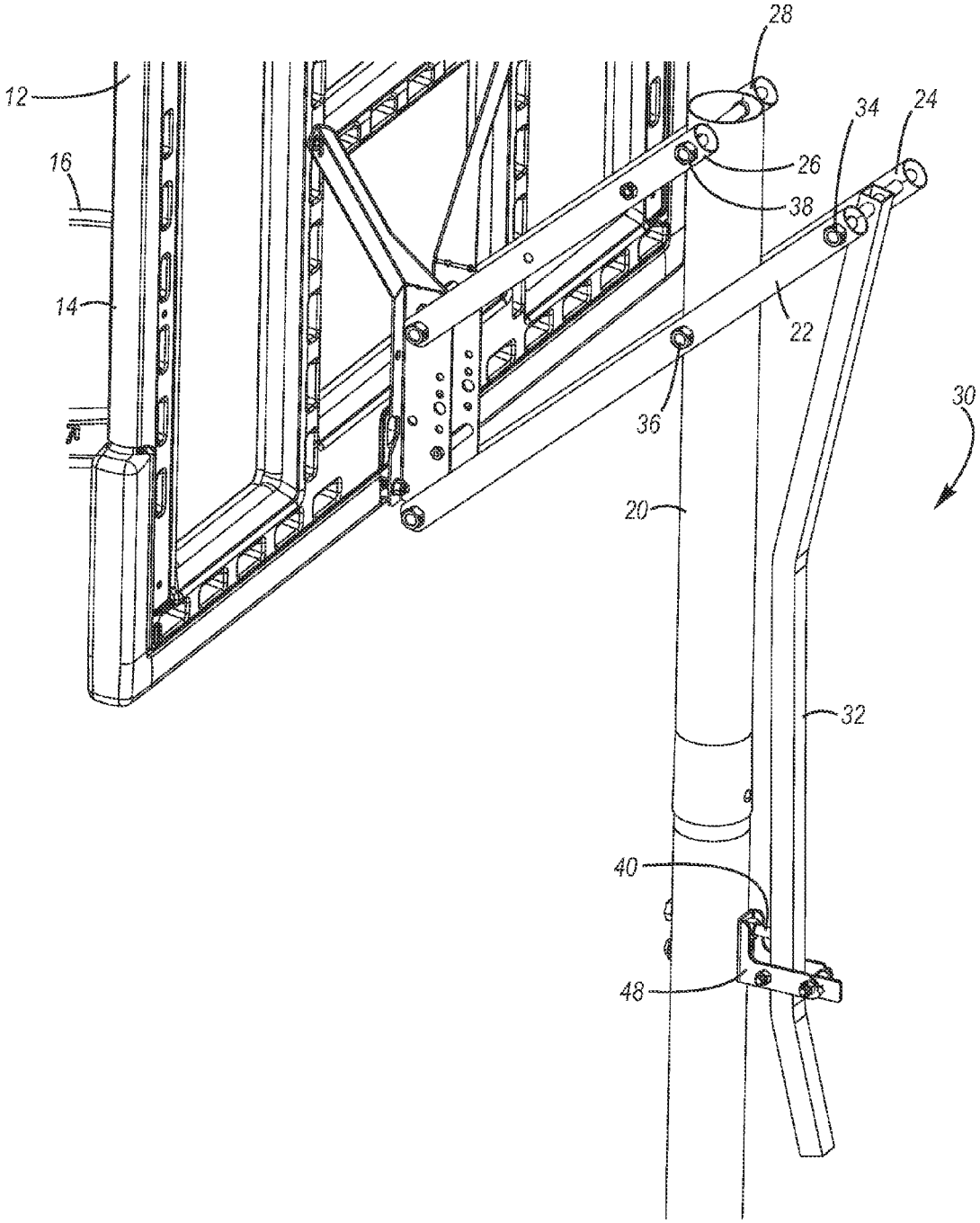
FIG. 3 is an enlarged view of a portion of the basketball system shown in FIG. 2, illustrating an adjustment assembly.

In further detail, as best shown in FIG. 3, the basketball system 10 may include an adjustment assembly 30 that is sized and configured to adjust the height of basketball goal 12. The adjustment assembly 30 may, for instance, be sized and configured to move at least a portion of the support structure 18, such as one or more of the connecting members 22, 24, 26 and/or 28, so that the height of the basketball goal 12 may be adjusted.

In particular, the adjustment assembly 30 may include an arm 32 that may be used to move one or more of the connecting members 22, 24, 26, 28, which may allow the height of the basketball goal to be adjusted. Preferably the arm 32 is connected to a connecting member and moving the arm may cause the connecting member to raise or lower the basketball goal 12. For instance, the arm 32 may be pivotally or otherwise movably connected to the connecting members 22, 24 by a fastener 34, such as a bolt. Advantageously, when the arm 32 moves downwardly, the basketball goal 12 may raise. Alternatively, when the arm 32 moves upwardly, the basketball goal 12 may be lowered. In particular, the connecting members 22, 24, 26, 28 may be pivotally connected to the support pole 20 using fasteners 36, 38 and moving the arm 32 downwardly may cause the connecting members 22, 24, 26, 28 to pivot upwardly about the fasteners and thus raise the basketball goal 12, while moving the arm upwardly may cause the connecting members to pivot downward about the fasteners and thus lower the basketball goal. Of course, in some instances, moving the arm 32 downwardly may lower the basketball goal 12 and moving the arm upwardly may raise the basketball goal depending, for example, upon the particular arrangement and/or interconnection of the arm and the connecting members 22, 24, 26, 28.

Advantageously, a portion of the basketball goal 12, connecting members and a portion of the support pole 20 may form at least a portion of a four-bar linkage. In addition, a portion of the basketball goal, a first connecting member, a portion of the support pole 20 and a second connecting member may have a generally parallelogram configuration. These components may also form part of a four-pivot linkage, if desired.

Figure 4:
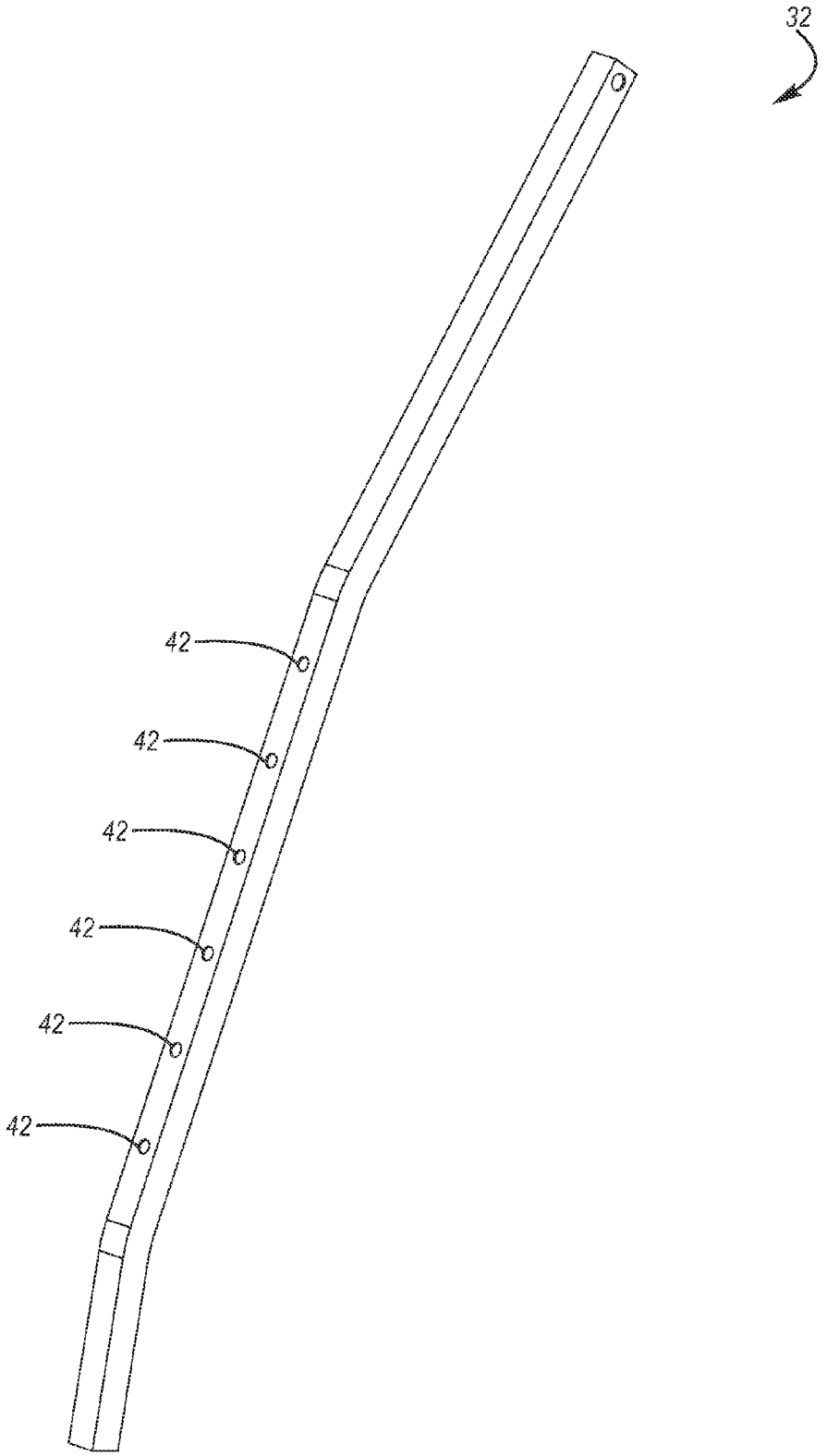
FIG. 4 is a perspective view of a portion of the adjustment assembly shown in FIG. 3, illustrating an arm.

Significantly, the adjustment assembly 30 may be sized and configured to secure the basketball goal at various heights. In particular, the adjustment assembly 30 may include one or more coupling or engaging members that may help secure the arm 32 in a variety of generally fixed positions and thus secure the basketball goal 12 at various heights. For example, the adjustment assembly 30 may include an engaging member (such as a fastener 40, pin or other suitable structure) that may be sized and configured to engage the arm 32. Specifically, the fastener 40 may be sized and configured to engage one or more coupling or engaging members of the arm 32 (such as receiving portions 42 shown in FIG. 4), which may restrict the arm's upward and/or downward movement and thus help secure the basketball goal 12 at desired height. As shown in FIGS. 5-8, the fastener 40 may comprise a bolt 44 and a nut 46, and at least a portion of the bolt may be selectively inserted into, contact, abut and/or engage a receiving portion 42. Although the fastener 40 is illustrated as being connected to the support pole 20 and the receiving portions 42 are illustrated as being formed in the arm 32, the fastener could be connected to the arm and the receiving portions could be formed in the support pole, if desired. Moreover, the arm 32 could be secured to the support member 18 using other suitable structures and components.

Figure 7:
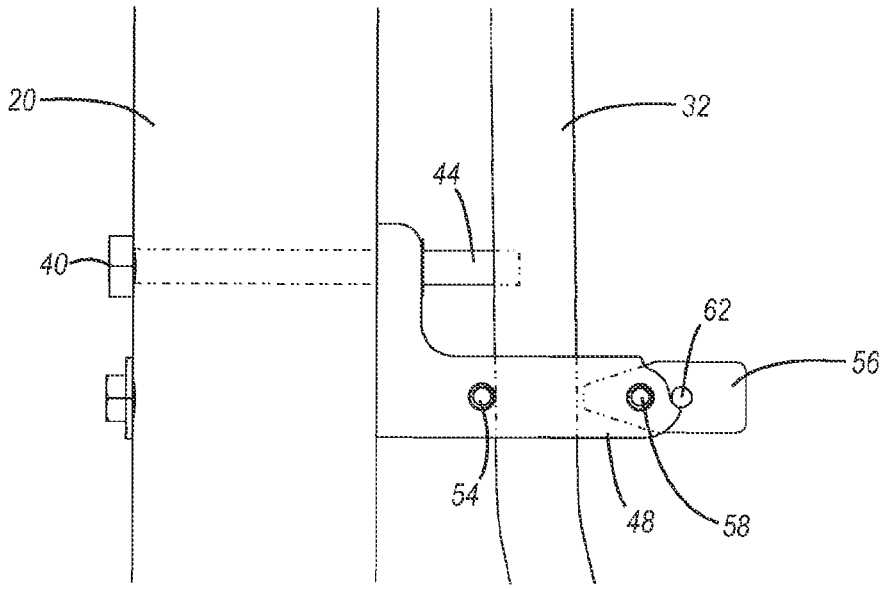
FIG. 7 is a side view of a portion of the basketball system shown in FIG. 5, illustrating the stop in a locked position.

The adjustment assembly 30 may also include additional engaging members that may be sized and configured to contact, abut and/or engage other portions of the arm 32 to help restrict the movement of the arm relative to the fastener 40 and thus help secure the basketball goal 12 at desired the height. For example, the adjustment assembly 30 may include a bracket 48, which may be connected to the support pole 20 by the fastener 40 and may include stops (such as flanges 50, 52) that may contact, abut and/or engage one or more portions of the arm 32, which may restrict lateral movement of the arm. The adjustment assembly 30 may also include a stop 54 (such as a fastener connected to the bracket 48) that may restrict forward movement of the arm 32, as shown in FIG. 7. By restricting this forward movement, the stop 54 may help limit how far the bolt 44 may be inserted into the receiving portion 42, which may help prevent the end of the bolt from contacting and/or damaging an interior portion of the arm 32 and may help prevent damage to the bolt itself. The adjustment assembly 30 may further include a stop 56 (such as a cam or tab connected to the bracket 48) that may contact, abut and/or engage a rear portion of the arm 32 to restrict the arm's rearward movement, as best shown in FIG. 7. By restricting this rearward movement, the stop 54 may help prevent the bolt 44 from being withdrawn from the receiving portion 42, which may help retain the basketball goal 12 at a desired height.

Figure 6:
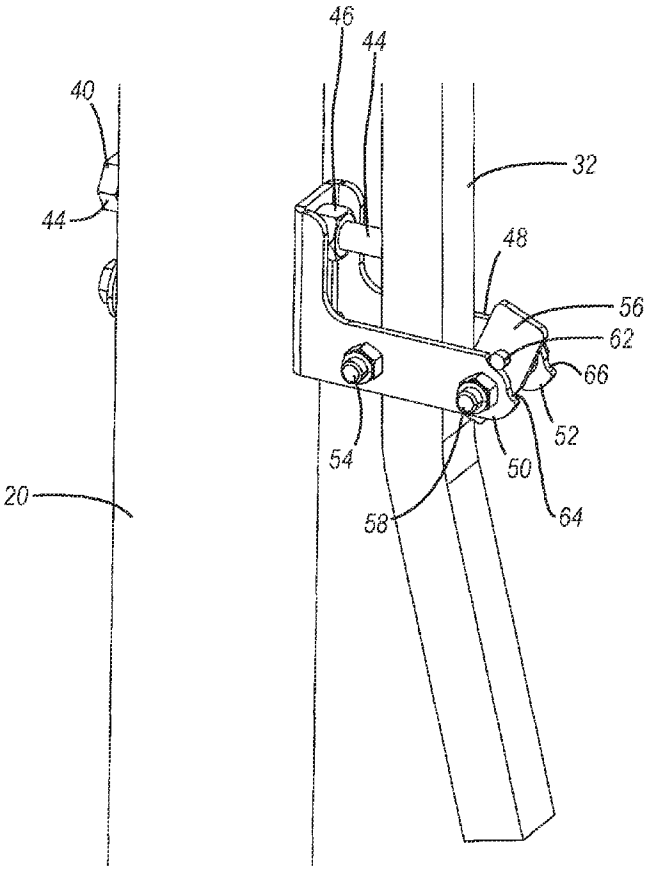
FIG. 6 is a perspective view of a portion of the basketball system shown in FIG. 5, illustrating the stop in an unlocked position.
Figure 5:
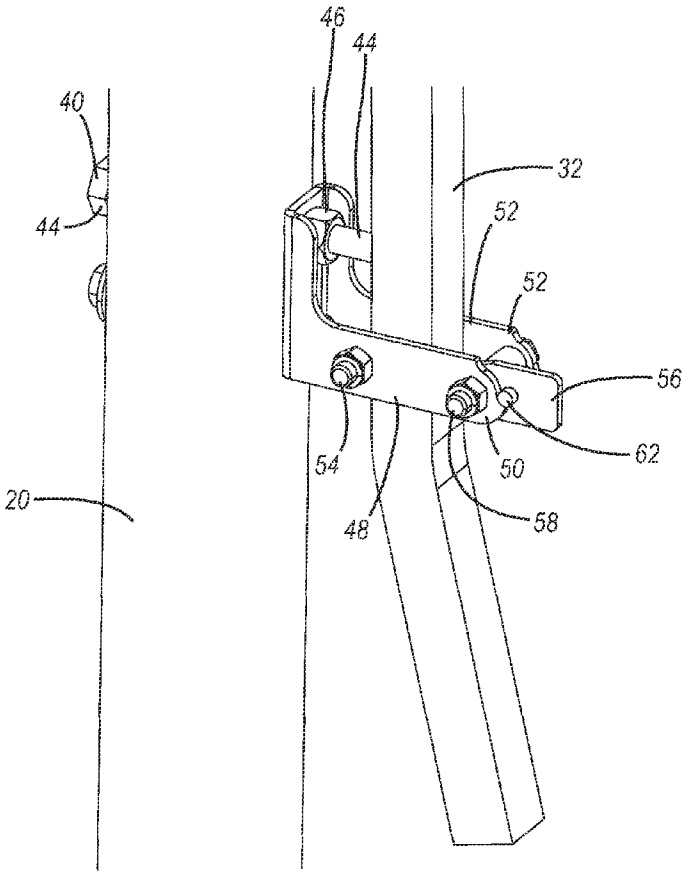
FIG. 5 is a perspective view of a portion of the basketball system shown in FIG. 3, illustrating a stop in a locked position and the arm secured in a fixed position.
Figure 8:
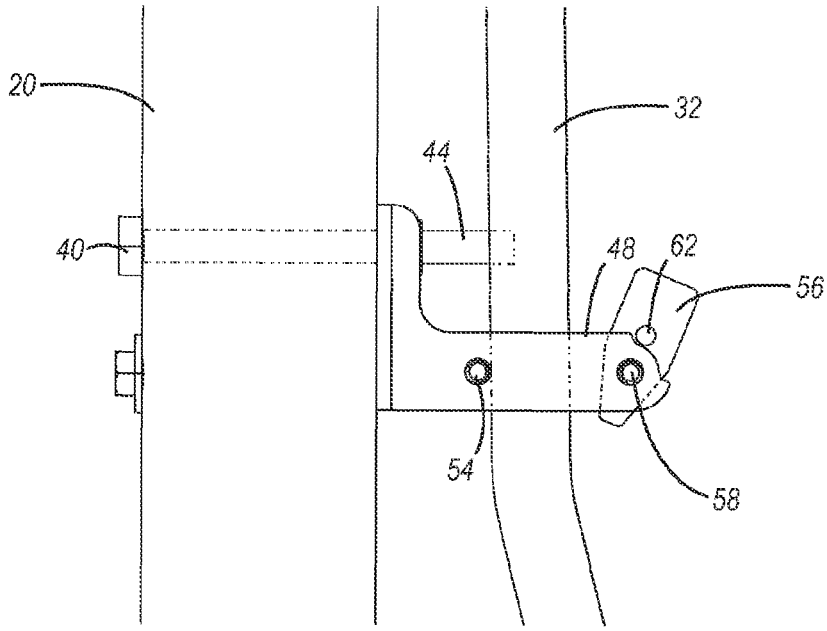
FIG. 8 is a side view of a portion of the basketball system shown in FIG. 5, illustrating the stop in an unlocked position.

In further detail, the stop 56 may be pivotally or otherwise movably connected to the bracket 48 using a fastener 58 and is preferably sized and configured to pivot or otherwise move between a locked position (such as shown in FIGS. 5 and 7) and an unlocked position (such as shown in FIGS. 6 and 8). When the stop 56 is in the locked position, the stop advantageously helps to maintain the arm 32 in a first position in which the fastener 40 engages a first receiving portion 42 formed in the arm. When the stop 56 is moved to the unlocked position, the arm 32 may be moved away from the first position such that the fastener 40 no longer engages the first receiving portion 42. The arm 32 may then be moved to a second position in which the fastener 40 engages a second receiving portion 42 formed in the arm, and the stop 56 may be returned to the locked position to help maintain the arm in the second position. By moving the arm 32 and the stop 56 in this fashion, the height of the basketball goal 12 may advantageously be adjusted from a first generally fixed height to second higher or lower generally fixed height.

Figure 9:
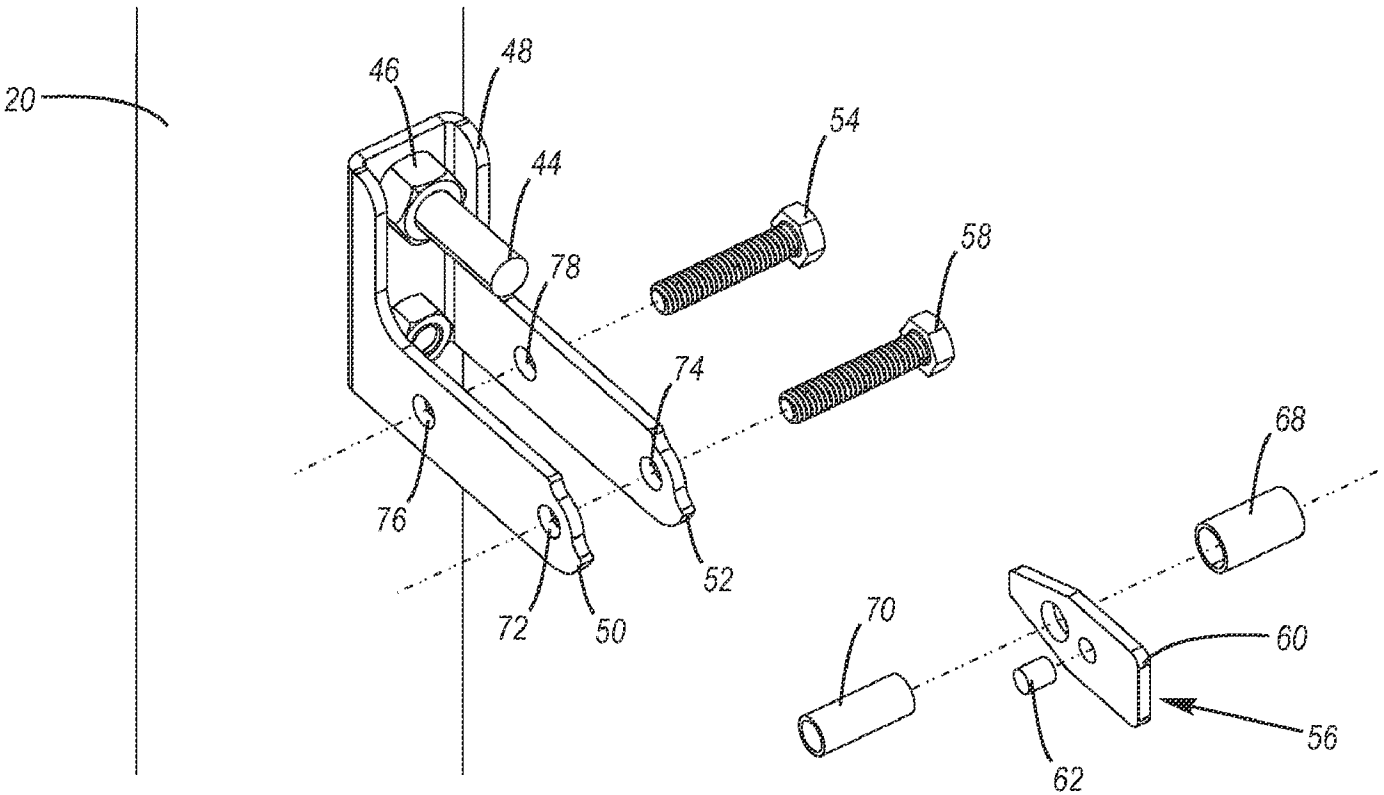
FIG. 9 is a partially exploded view of a portion of the basketball system shown in FIG. 5, illustrating a portion of the adjustment assembly.

The stop 56 is preferably biased towards the locked position. In particular, the stop 56 may be a gravity-biased stop that, as shown in FIG. 9, may include an enlarged portion 60 that is sized and configured to allow gravity to bias the stop from the unlocked position towards the locked position. If desired, the stop 56 may be biased from the unlocked position towards the locked position using one or more other suitable biasing members, such as springs, resilient structures and the like.

As shown in FIGS. 5-9, a pin or projection 62 may be connected to, or form part of, the stop 56. The pin 62 may contact, abut and/or engage one or more portions of the bracket 48 to help prevent the stop 56 from moving outside of a desired range of motion. In particular, as shown in FIG. 6, the flanges 50, 52 of the bracket 48 may include projections 64, 66 that may (as shown in FIGS. 5 and 7) contact, abut and/or engage the pin 62 to prevent the stop 56 from moving past the locked position. In addition, where the stop 56 is gravity-biased, the pin 62 may rest upon the projections 64, 66 when the stop is in the locked position.

As shown in FIG. 9, one or more sleeves may be used to help pivotally or otherwise movably connect the stop 56 to the bracket 48. For example, a first sleeve 68 may be connected to, or form part of, the stop 56, a second sleeve 70 may be inserted into the first sleeve and a portion of the fastener 58 may be inserted through the first and second sleeves and openings 72, 74 in the bracket 48 to pivotally or otherwise movably connect the stop to the bracket.

As mentioned above, the stop 54 may be connected to the bracket 48 and may contact, abut and/or engage a front portion of the arm 32 to restrict the arm's forward movement. As shown in FIG. 9, the stop 54 may be inserted through openings 76, 78 to connect the stop to the bracket 48.

Figure 10:
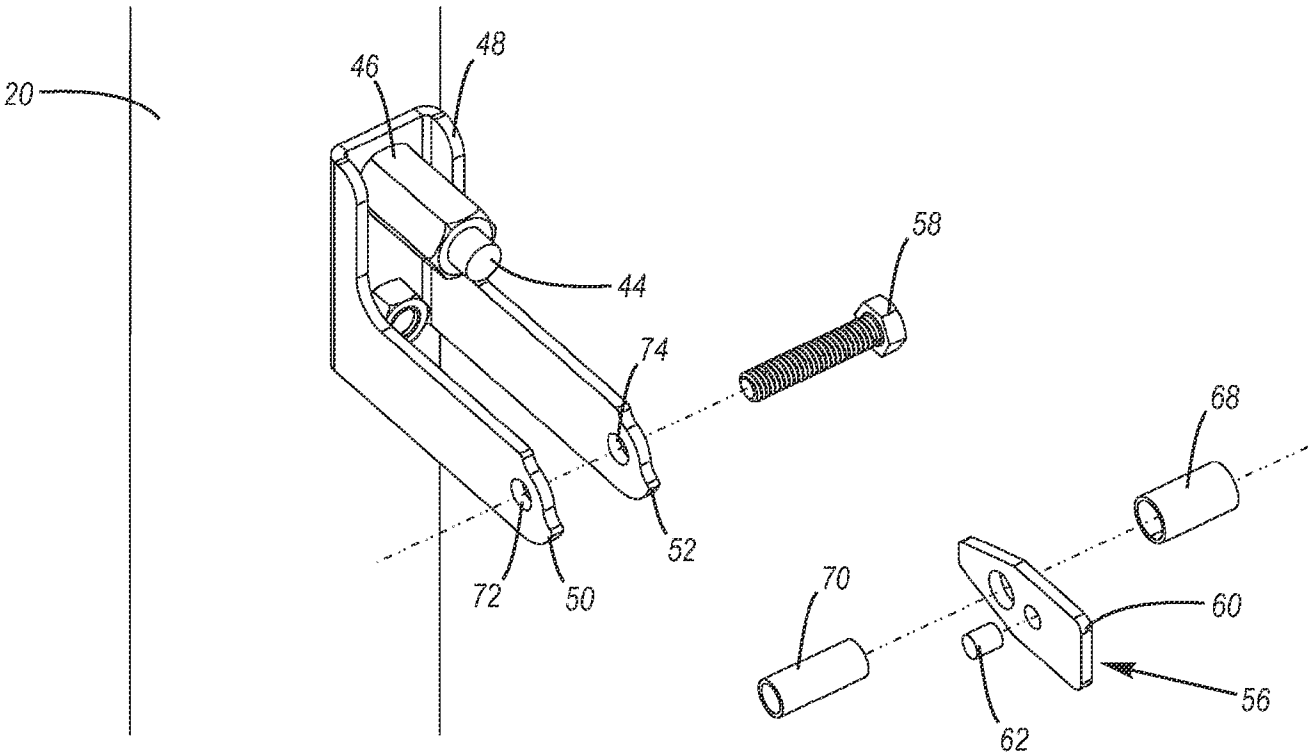
FIG. 10 is a partially exploded view of a portion of the basketball system shown, illustrating another exemplary portion of an adjustment assembly that may be used in connection with a basketball system.
Figure 11:
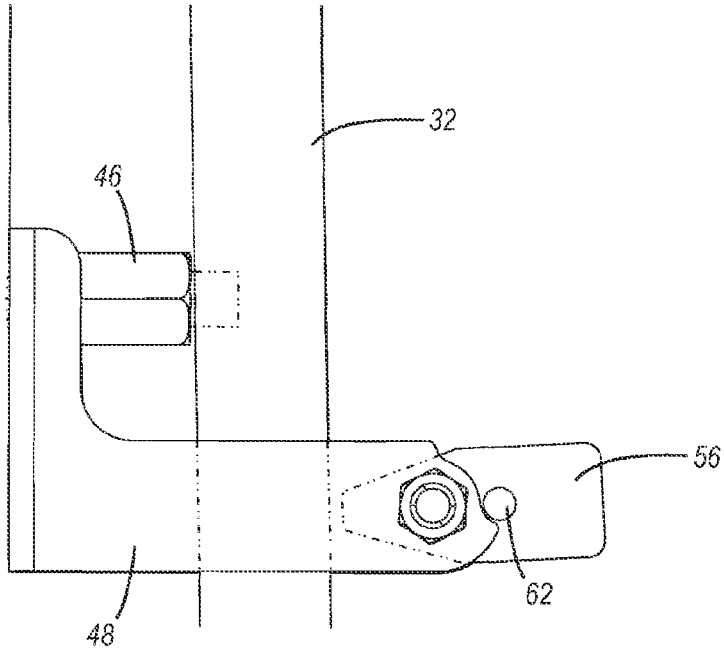
FIG. 11 is a side view of a portion of the basketball system shown in FIG. 10, illustrating a stop in a locked position and the arm secured in a fixed location.
Figure 12:
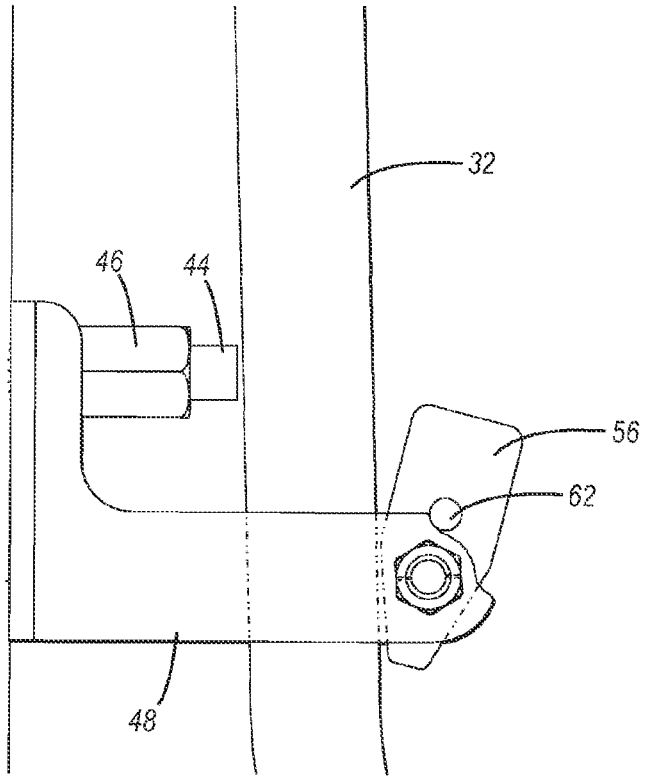
FIG. 12 is a side view of a portion of the basketball system shown in FIG. 10, illustrating the stop in an unlocked position and the arm being readily movable.

Other structures, however, may be used to restrict the arm's forward movement. For example, as shown in FIGS. 10-11, the nut 46 may be adapted to contact abut and/or engage a front portion of the arm 32 to restrict the arm's forward movement. The nut 46 may, for instance, have an elongated shape that restricts the arm's forward movement, which may help prevent the end of the bolt 44 from contacting and/or damaging an interior portion of the arm 32 and may help prevent damage to the bolt itself Desirably, the nut's elongated shape may also help strengthen and/or reinforce the bolt 44. The elongated nut 46 preferably has a length that is at least as long as its width, but may have other suitable dimensions.

As shown in FIG. 1, the basketball system 10 may include a resistance mechanism 80, such as a dampener, spring, biasing member, gas-filled piston and the like. The dampener 80 is preferably sized and configured to assist in adjusting the height of the basketball goal 12. For example, the dampener 80 may facilitate movement of the basketball goal 12 from a first height to a second height. In particular, the dampener 80 may be used to at least partially counteract the force of gravity to allow the height of the basketball goal 12 to be more easily adjusted. The dampener 80 may, for example, be connected to a portion of the support structure 18, such as the connecting members 26, 28, and to a portion of the basketball goal, such as the backboard 14. It will be appreciated, however, that the dampener 80 may be connected to other suitable portions of the basketball goal 12, the support structure 18, the adjustment assembly 30 and/or the basketball system 10, if desired.

Figure 13:
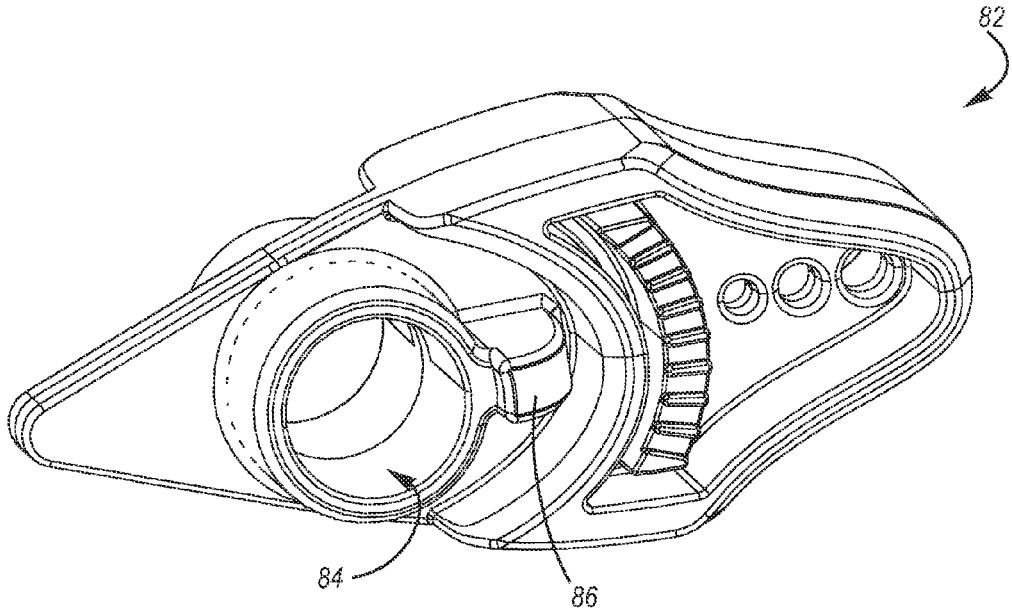
FIG. 13 is a perspective view of an exemplary stop that may be used in connection with an adjustment assembly for a basketball system.

If desired, one or more of the stops may be constructed from materials such as plastic and the stops may be integrally formed as part of a unitary, one-piece structure during a molding process. For example, as shown in FIG. 13, an exemplary stop 82 may be constructed from plastic and may be integrally formed as part of a unitary, one-piece structure during an injection molding process or other suitable molding or manufacturing processes. The stop 82 may include the features and functionality of the stop 56 (as best shown in FIGS. 5-12). Thus, the stop 82 may be used in place of the stop 56, if desired. The stop 82, of course, may also include other features. It will be appreciated that the stops may have other suitable shapes, sizes, configurations and arrangements depending, for example, upon the size, shapes, configuration and/or intended use of the basketball system 10 and/or adjustment assembly 30.

In greater detail, as shown in FIG. 13, the stop 82 may include an opening 84 that may be sized and configured to receive the fastener 58 to pivotally or otherwise movably connect the stop to the bracket 48. The stop 82 may also include a pin or projection 86 that may contact, abut and/or engage one or more portions of the bracket 48 to help prevent the stop 82 from moving outside of a desired range of motion. In particular, the projections 64, 66 of the bracket's flanges 50, 52 may contact, abut and/or engage the pin 86 to prevent the stop 82 from moving past the locked position. In addition, where the stop 82 is gravity-biased, the pin 86 may rest upon the projections 64, 66 when the stop is in the locked position. Significantly, if the stop 82 is constructed using a molding process, the opening 84 and/or the pin 86 may be integrally formed as part of a unitary, one-piece stop during the molding process.

Figure 14:
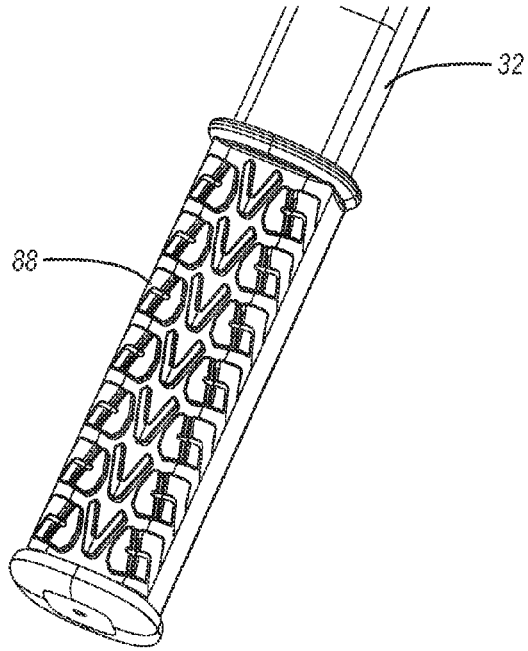
FIG. 14 is a perspective view of an exemplary handle and grip that may be used in connection with an adjustment assembly for a basketball system.

As shown in FIG. 14, a grip 88 may be connected to, or form part of, the arm 32. Desirably, the grip 88 may be constructed from a generally resilient material, such as rubber, which may enhance the ability of a user to grasp the arm 32. The grip 88 may include a receiving portion sized and configured to receive and/or retain a portion of the arm 32 using a snap, friction and/or interference fit. It will be appreciated that the grip 88 may be constructed from other materials having other suitable properties and that the grip may be connected to the arm using one or more fasteners; a snap, friction and/or interference fit; adhesives and/or any other suitable means.

One or more components of the basketball system are preferably constructed from lightweight, yet strong materials. For example, the support pole 20, the connecting members 22, 24, 26, 28 and/or the arm 32 may be constructed from metal, such as steel, and these components may be formed from tubes. The arm 32 preferably has a generally rectangular cross-sectional shape, while the support pole 20 and the connecting members 22, 24, 26, 28 preferably have a generally circular cross-sectional shape. It will be appreciated, however, that the support pole 20; the connecting members 22, 24, 26, 28 and the arm 32 may be constructed from other suitable materials and may have other appropriate shapes, sizes, configurations and arrangements depending, for example, upon the intended use of the basketball system 10 and/or adjustment assembly 30.

Although this invention has been described in terms of certain preferred embodiments, other embodiments apparent to those of ordinary skill in the art are also within the scope of this invention. Accordingly, the scope of the invention is intended to be defined only by the claims which follow.

What is claimed is:

1. A basketball system comprising:

a basketball goal including a backboard and a rim;

a support structure that is sized and configured to support the basketball goal at a plurality of heights, the support structure comprising:

a support pole; and one or more connecting members connecting the support pole and the basketball goal; and a height adjustment assembly that is sized and configured to adjust the height of the basketball goal, the height adjustment assembly comprising:

an arm connected to at least one of the connecting members, the arm including a plurality of receiving portions formed in an inner surface of the arm that is disposed towards the support pole, the arm including a generally planar outer surface that is disposed away from the support pole;

an engaging member extending outwardly from the support pole, the engaging member being sized and configured to engage a first receiving portion of the plurality of receiving portions to secure the basketball goal at a first height and to engage a second receiving portion of the plurality of receiving portions to secure the basketball goal at a second height;

a bracket connected to the support pole; and a stop pivotally connected to the bracket, the stop movable between an unlocked position in which the stop does not engage the generally planar outer surface of the arm and a locked position in which the stop engages the generally planar outer surface of the arm, the stop comprising:

a first end that engages the arm when the stop is in the locked position, the first end being disengaged from the arm when the stop is in the unlocked position to allow the arm to move;

a second end that extends outwardly and away from the arm, the second end including an engagement surface that facilitates movement of the stop between the locked and unlocked positions; and an engagement portion that slides along a surface of the bracket when the stop moves between the locked and unlocked positions.

2. The basketball as in claim 1, wherein when the stop is in the locked position and the stop engages the generally planar outer surface of the arm, the engaging member engages one of the plurality of receiving portions in the inner surface of the arm to secure the basketball goal at a desired height; and wherein when the stop is in the unlocked position, the engaging member can be disengaged from the receiving portions in the inner surface of the arm to allow the height of the basketball goal to be adjusted.

3. The basketball system as in claim 1, wherein the engaging member includes a first portion that connects the bracket to the support pole and a second portion that extends outwardly and away from the support pole, the second portion selectively engaging the plurality of receiving portions in the inner surface of the arm.

4. The basketball as in claim 1, wherein a portion of the stop pivots upwardly as the stop is moved from the locked position to the unlocked position.

5. The basketball as in claim 1, wherein the stop includes a guide pin and the bracket includes a guide track;

wherein movement of the stop between the locked and unlocked positions is controlled and limited by the movement of the guide pin relative to the guide track.

6. The basketball system as in claim 5, wherein the guide pin extends outwardly and away from the stop and the guide track is formed by an outer surface of the bracket.

7. The basketball system as in claim 1, wherein the adjustment assembly further comprises a biasing member that is sized and configured to bias the stop towards the locked position.

8. The basketball system as in claim 1, wherein the stop comprises a cam that helps maintains the arm in the fixed position when the stop is in the locked position.

9. The basketball system as in claim 1, wherein the first end of the stop includes an engagement surface that engages the generally planar outer surface of the arm when the stop is in the locked position, the engagement surface of the stop pivoting outwardly and away from the generally planar outer surface of the arm when the stop is moved from the locked position to the unlocked position.

10. A basketball system comprising:

a basketball goal including a backboard and a rim;

a support structure that is sized and configured to support the basketball goal above a playing surface;

a connecting structure connecting the support structure and the basketball goal; and a height adjustment assembly that is sized and configured to adjust the height of the basketball goal relative to the playing surface, the height adjustment assembly comprising:

an arm including a first end connected to the connecting structure and a second end including a plurality of coupling portions; and a locking mechanism that is sized and configured to secure the basketball goal at a desired height relative to the playing surface, the locking mechanism comprising:

a coupling member that is sized and configured to be selectively coupled to one of the plurality of coupling portions of the arm to secure the arm in a fixed position relative to the support structure;

a bracket connected to the support structure; and a stop pivotally connected to the bracket, the stop movable between an unlocked position in which the arm may be moved to allow the height of the basketball goal to be adjusted and a locked position in which the stop engages the arm and the coupling member of the locking mechanism is coupled to one of the coupling portions of the arm to secure the basketball goal at a height above the playing surface, the stop comprising:

a first end that engages the arm when the stop is in the locked position, the first end being disengaged from the arm when the stop is in the unlocked position to allow the arm to move;

a second end that extends outwardly and away from the arm, the second end including an engagement surface that facilitates movement of the stop between the locked and unlocked positions; and an engagement portion that slides along a surface of the bracket when the stop moves between the locked and unlocked positions.

11. The basketball system as in claim 10, wherein the coupling member includes a first portion that attaches the bracket to the support structure and a second portion that extends outwardly and away from the support structure, the second portion of the coupling member being selectively coupled to the coupling portions of the arm.

12. The basketball system as in claim 10, wherein the bracket of the locking mechanism includes a pair of flanges that extend outwardly and away from the support structure;

wherein the stop is pivotally connected to the flanges of the bracket; and wherein the arm is disposed between the support structure, the flanges and the stop.

13. The basketball system as in claim 10, wherein the stop includes a guide member and the bracket includes a guide;

wherein the guide guides the guide member when the stop is moved between the locked and unlocked positions.

14. The basketball system as in claim 13, wherein the guide member comprises an outwardly extending projection and the guide comprises a curved outer surface of a flange of the bracket.

15. The basketball system as in claim 10, wherein the stop allows the arm to be moved away from the support structure and the coupling member to be disconnected from the coupling portion of the arm when the stop is in the unlocked position; and wherein the second end of the arm is disposed towards the support structure and the coupling member is connected to one of the coupling portions of the arm when the stop is in the locked position.

16. The basketball system as in claim 10, wherein the plurality of coupling portions are disposed in an inner surface of the arm facing the support pole; and wherein the arm includes a generally planar outer surface that is disposed away from the support pole.

17. The basketball system as in claim 16, wherein when the stop is in the locked position, an engagement surface of the stop engages the generally planar outer surface of the arm; and wherein when the stop is in the unlocked position, the coupling member can be disengaged from the coupling portion in the inner surface of the arm to allow the height of the basketball goal to be adjusted.

18. The basketball system as in claim 17, wherein an end of the stop pivots upwardly and towards the arm as the stop is moved from the locked position to the unlocked position; and wherein the engagement surface of the stop pivots downwardly and away from the arm as the stop is moved from the locked position to the unlocked position.

19. The basketball system as in claim 10, wherein the height adjustment assembly further comprises a biasing member that is sized and configured to bias the stop towards the locked position.

* * * * *